US007725970B2

(12) United States Patent
Tuttle et al.

(10) Patent No.: US 7,725,970 B2
(45) Date of Patent: Jun. 1, 2010

(54) CONTROL SYSTEM AND METHOD FOR SUPPLYING DETERGENT AND OTHER FLUIDS TO MULTIPLE WASHING MACHINES

(75) Inventors: Robert J. Tuttle, 1 Orchard La., Littleton, MA (US) 01460; William J. Souza, 47 Lapham St., Fall River, MA (US) 02721

(73) Assignees: Robert J. Tuttle, Littleton, MA (US); William J. Souza, Fall River, MA (US)

( * ) Notice: Subject to any disclaimer, the term of this patent is extended or adjusted under 35 U.S.C. 154(b) by 1866 days.

(21) Appl. No.: 10/665,124

(22) Filed: Sep. 22, 2003

(65) Prior Publication Data

US 2004/0098811 A1 May 27, 2004

Related U.S. Application Data

(60) Provisional application No. 60/428,661, filed on Nov. 25, 2002.

(51) Int. Cl.
*D06F 33/02* (2006.01)

(52) U.S. Cl. ..... 8/158; 68/12; 68/12.19; 68/12.22; 68/17 R; 68/27; 68/207

(58) Field of Classification Search ..... 8/158; 68/12, 12.19, 12.22, 17 R, 27, 207
See application file for complete search history.

(56) References Cited

U.S. PATENT DOCUMENTS 3,192,744 A * 7/1965 Pittendreigh et al. ..... 68/12.19
3,362,515 A * 1/1968 Mititaka Yamamoto et al. .. 194/210
3,864,616 A * 2/1975 Hiortdahl ..... 320/126
3,891,123 A * 6/1975 Blackburn ..... 222/64
5,014,211 A 5/1991 Turner et al.
5,195,338 A 3/1993 Russo
5,435,157 A 7/1995 Laughlin
5,758,521 A 6/1998 Roberts
5,978,995 A * 11/1999 Bruntz et al. ..... 8/158

* cited by examiner

*Primary Examiner*—Michael Barr

(57) ABSTRACT

A washing machine control system is combined with a working fluid dispensing system and a payment processing system to provide a merged system for automatically providing detergents, bleach, softeners and the like in a pay-as-you-go laundry environment, such as public laundry facilities in Laundromats, dormitories, apartment complexes and the like.

36 Claims, 6 Drawing Sheets

CONTROL SYSTEM AND METHOD FOR SUPPLYING DETERGENT AND OTHER FLUIDS TO MULTIPLE WASHING MACHINES

RELATED APPLICATIONS

This application is a conversion of and claims priority from Provisional Application Ser. No. 60/428,661, filed Nov. 25, 2002.

BACKGROUND OF THE INVENTION

1. Field of the Invention

This invention relates to the supply of working fluids such as detergents, bleach, softeners, etc. to a group of washing machines installed for use in apartment buildings, dormitories, public laundries and the like.

2. Brief Description of Related Developments

Using as an example the typical dormitory environment, a group of washing machines may be installed in a location for access to the student residents of a particular building or group of apartments. These washing machines are generally coin operated and paired with dryers to provide a laundry facility. Each user brings their own detergent, bleach, and softener or whatever chemicals they choose to use in their laundry routine. Coin operated dispensers may be available to provide individual packets of detergent, etc., but there is no system, which provides for selection, payment, and dispensing of metered working fluids to a group of washing machines.

U.S. Pat. Nos. 5,195,338 and 5,758,521 describe dispensers designed for individual washing machines either domestic or commercial. These are self-contained systems involving detergent and softener reservoirs, which are operatively associated with the washer control mechanism to dispense working fluids to the washer tub. Neither of these systems are associated with payment operations.

U.S. Pat. No. 3,891,123 describes a system for dispensing multiple working fluids to a group of commercial washing machines. Chemicals which are prediluted in a main reservoir are pumped to a holding tank. Each washing machine is provided with an individual supply tank that provides a metered amount of chemical to the washing machine. There is no payment operation associated with this system.

In U.S. Pat. No. 5,014,211, a further dispensing system is shown which utilizes a system of containers and pumps, which hold and distribute working chemicals to multiple washers. The system of the '211 patent uses a water flush system to meter the chemicals. U.S. Pat. No. 5,435,157 describes another system for the same purpose. In the '156 patent water is used as a motive force to operate venturi valves that control the dispensing operation. Neither of these patents involves a payment operation.

All of the above systems are designed to minimize the need for operator interaction. This helps to avoid spills, overfilling, and mistakes in the quantity of fluid. The above systems are designed for commercial laundries in which the machines are operated by trained technicians. The problem of operator error is worse where the washing machines are part of public or semiprivate laundry operations. Yet there are no systems for automating detergent dispensing that are coupled with a payment system for use in such operations.

It is a purpose of this invention to provide a working fluid dispensing system that will automatically dispense a metered amount of detergent or other chemical to a selected washing machine in response to inputs from a user interface. It is another purpose of this invention to associate the dispensing system with a payment operation, which allows payment for both use of the washing machine and for a correct amount of working fluid, as part of the operation. It is a purpose of this invention to provide the capability of adapting the payment operation for use with a centralized payment system, such as a credit card or campus card system. It is also a purpose of this invention to optimize the use of the working fluids to minimize both operating costs and environmental impact.

SUMMARY OF THE INVENTION

A combination of three control sequences are merged to provide a system for dispensing working fluids, such as detergents, fabric softeners, and bleach, to a group of washing machines assembled in a pay-as-you-go environment. The system is controlled by a system controller in cooperation with a transaction authorization system including a payment processor which receives an offer to pay by cash, credit card, ATM card or other recognizable medium. A user interface provides communication between the operator and the system controller. Through the user interface, the operator is prompted to select a washing machine as well as appropriate amounts and types of working fluids. The system controller calculates an amount for the transaction to enable the payment processor of the transaction authorization system to analyze the proffered payment. If the payment medium is authorized, the system controller activates the selected dispensing sequence through a dispensing controller.

The dispensing system consists of several tanks or reservoirs, which contain the working fluids available for use. The outlets of the tanks are connected by conduits through associated pumps to the inlet of a distribution manifold. The outlets of the manifold are connected by conduits through individually operated valves to each of the washing machines in a group. This arrangement of tanks, conduits, pumps, manifold, and valves form a fluid distribution system that is controlled by a dispensing controller. A series of flow sensors operate to monitor the flow of working fluids through the fluid distribution system to insure proper operation. The dose of working fluid dispensed into the washing machine is determined by the valve open time.

Each washing machine is equipped with a separate controller, which operates the machine according to a cycle selected by the user. The washing machine controller responds to signals from a gang controller through which the system controller can initiate the washing sequence. The gang controller monitors the status of the washer and reports to the system controller.

In operation the user submits a payment medium at the user interface, e.g., swipes a credit card through a reader. The payment processor responds by approving or rejecting the payment medium. If approved the system controller begins the control sequence by prompting the user to select a washing machine. The system controller checks the status of the selected machine through the gang controller and, if available, prompts the user to make a selection of working fluids. The amount of the transaction is calculated and processed through the chosen payment medium. The system controller initiates the dispensing of working fluids through the fluid distribution system. When the fluids are received at the washing machine, the washing machine is activated through the gang controller. This enables the user to load the machine, select the cycle and initiate the wash process by pressing a start button.

BRIEF DESCRIPTION OF THE DRAWINGS

The system of this invention is explained in more detail below with reference to the accompanying drawings, in which:

FIG. 4*b* is an illustration of a working fluid dispensing compartment for the washing machine of FIG. 4*a;*

DESCRIPTION OF THE PREFERRED EMBODIMENT

Figure 4A:
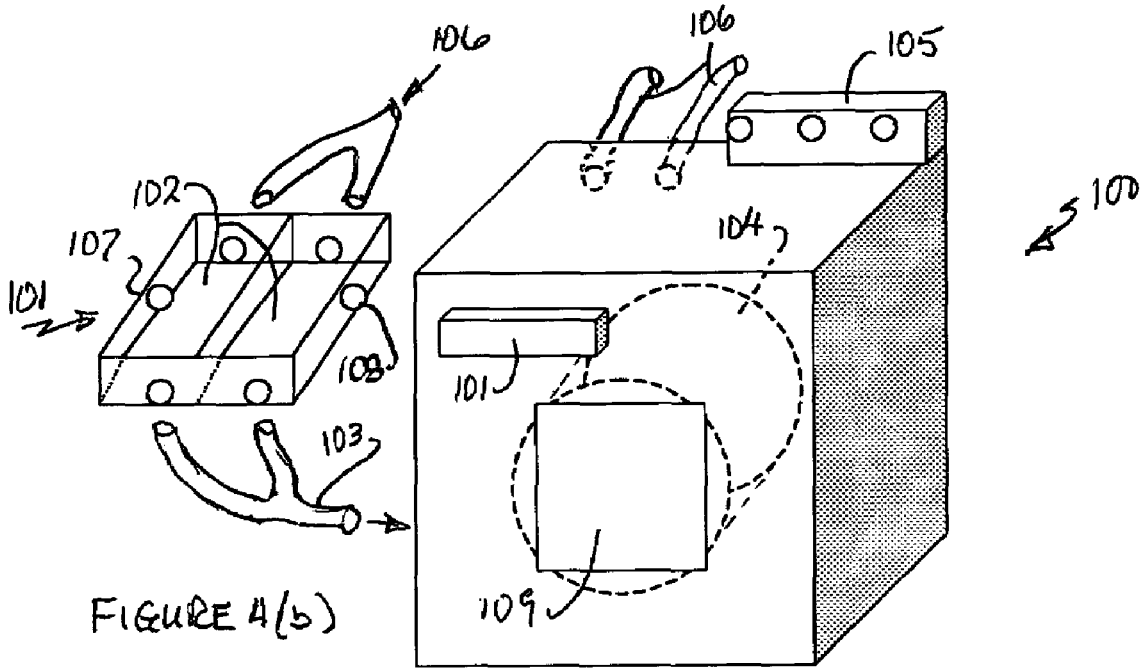
FIG. 4*a* is an illustration of a typical washing machine with which the system of this invention may be used.

For the purpose of illustration, this invention is described for use with a group of washing machines 100, as shown in FIG. 4. Washing machine 100 is constructed having a container 101 that may be subdivided into separate compartments 102. Each compartment is adapted to contain quantities of liquid detergent, softener, bleach or other working fluids used in the washing process. These fluids are to be added from compartment 102 to wash tub 104 during different cycles of an ongoing washing sequence. The container 101 is in communication via a flexible conduit 103 with the machine's wash tub 104, which is disposed below the container. A door 109 provides access to the wash tub 104.

Container 101 is provided with suitable dispensing apparatus, which is actuated by the washing machine's controller 105. The washing machine 100 diverts a portion of its inlet water flow 106 through one of the compartments 102, according to the current cycle of an on going washing sequence. The water flow is directed to flush compartment 102 and convey a quantity of working fluid into the wash tub 104. According to this invention, the dispensing system 30 injects a measured amount of a working fluid into the appropriate compartment 102 through inlets 107 and 108. The controller 105 responds to signals from a gang controller interconnected with the control system of this invention, as described above.

The system of this invention is equally adaptable to other types of washing machines, for example those which require dispensing of working fluids directly into the washing tub.

According to this invention, a washing machine control system is combined with a working fluid dispensing system and a payment processing system to provide a unique and efficient merged system for automatically providing detergents, bleach, softeners and the like in a pay-as-you-go laundry environment. Such environments include public laundry facilities in Laundromats, dormitories, apartment complexes and the like.

Figure 1:
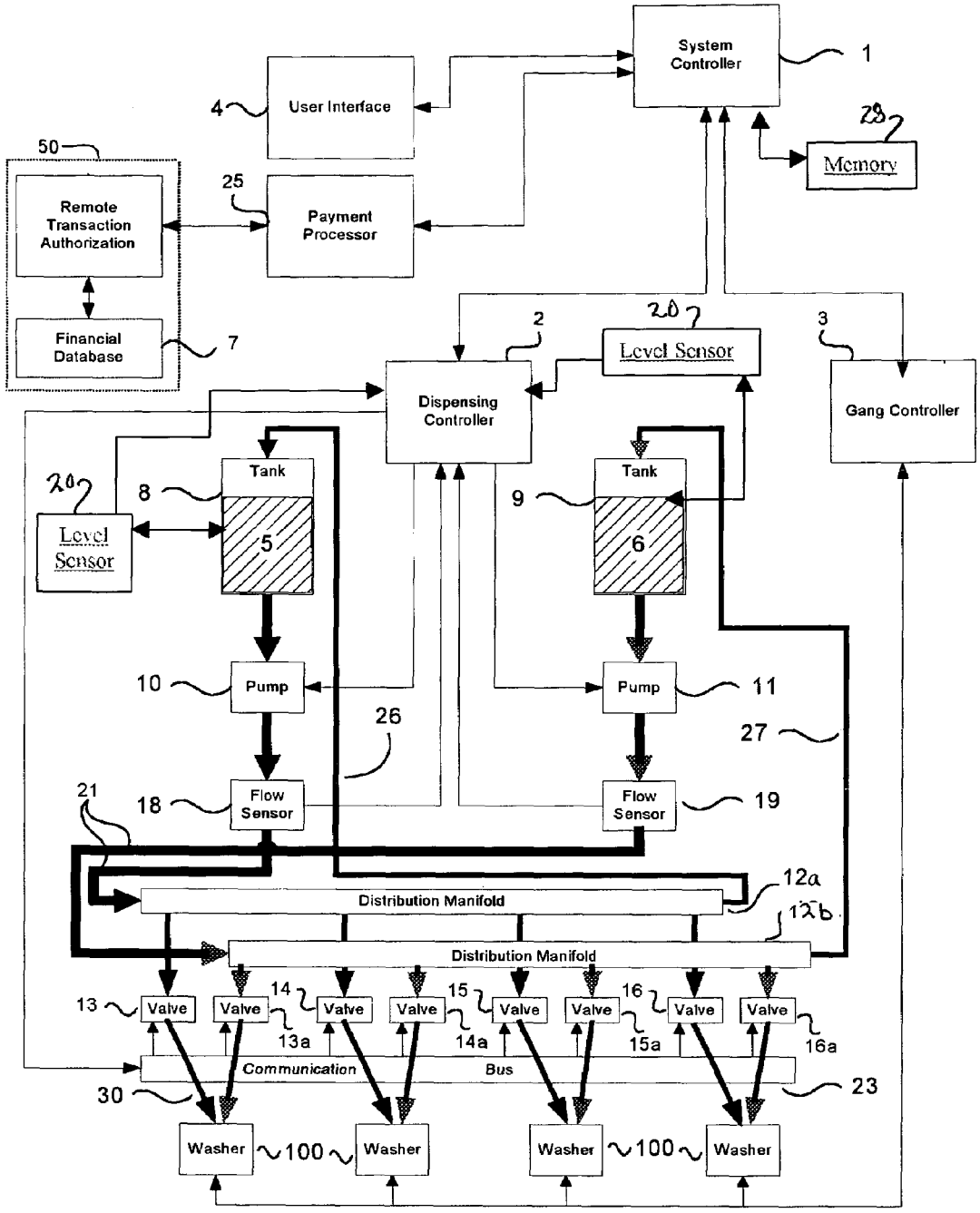
FIG. 1 is a schematic diagram of the overall control system of the subject invention.
Figure 2:
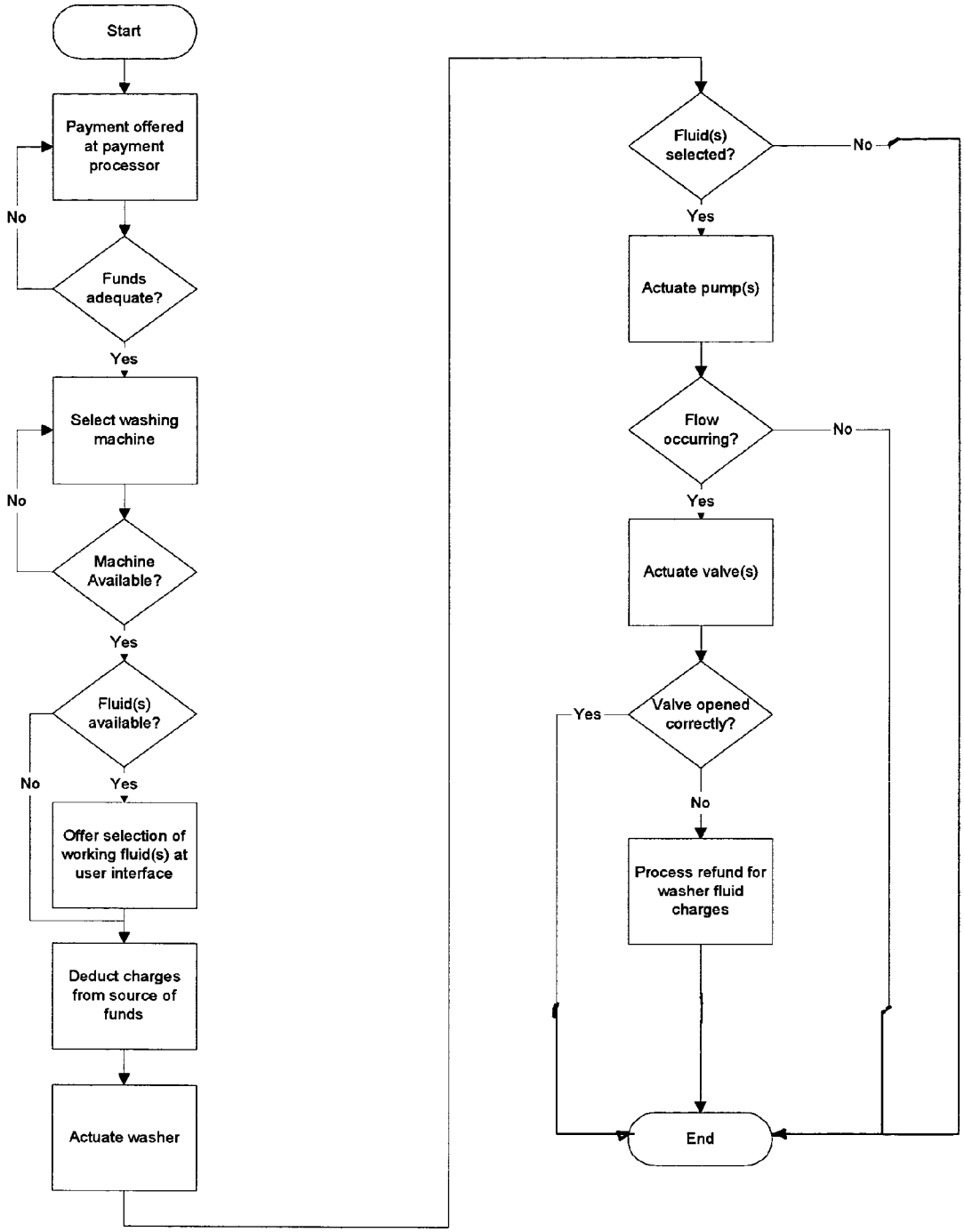
FIG. 2 is a chart of the steps of the dispensing process of this invention.

As shown in FIG. 1, the central role of the control hierarchy in this system is provided by system controller 1, which, through appropriate algorithms, directs the operation of dispensing controller 2 and gang controller 3. System controller 1 cooperates with a payment processor 25 to allow the purchase of laundry products and services in an integral system. Each element of the system hierarchy may be implemented by an appropriate microprocessor designed to provide the specified functions according to imbedded or stored algorithms.

Payment processor 25 forms part of a transaction authorization system 50 and operates to receive a payment by cash, credit card, ATM card or other recognizable medium. A point-of-sale payment processor of the type frequently used in banks, supermarkets, gas stations and the like could form at least part of transaction authorization system 50, which may also include a financial database 7, such as associated with a credit card or card activated college accounting system. In the latter instance, an account may be debited at the bursar's office against a prepaid balance or other accounting system. Such a college system could be directly connected by means of a campus computer network. In the alternative, a simple currency reader, which accepts bills and coins may be used where other payment methods are not convenient. A prepaid laundry/cash card, issued by a school or other central authority, is another alternative. The payment processing sequence and hardware can readily be adapted to any existing type of payment function.

A user interface 4, having a key pad or other appropriate input device and a display screen (not shown), allows the operator to select one of the washing machines 100 and appropriate working fluids. Through user interface 4, the user will be prompted to select, if desired, appropriate amounts and types of working fluids 5 and 6 to be automatically dispensed. Working fluids 5 and 6 will generally be detergent and bleach or fabric softener, but additional fluids could be provided as well.

The system controller 1 receives the inputs from the user interface 4 and prompts the user to present a payment medium to the payment processor 25. The proffered payment medium is analyzed in accordance with well-known methods and if acceptable, the transaction is cleared for further processing.

Through gang controller 3, system controller 1 receives signals, which are indicative of the status of the selected washing machine 100. If the selected machine 100 is available, working fluid selections, received from the user interface 4, are processed and dispensing system control processor 2 is instructed to dispense the selected working fluids 5 and/or 6 to the working fluid compartments 102 of washing machine 100.

In an alternative embodiment, each washing machine 100 may be equipped with an integral system controller 1 and a transaction authorization system 50. In this embodiment, the washing machine 100 would be connected directly to dispensing controller 2. An appropriate user interface 4 would be part of the washing machine, for example, on its control panel.

Figure 3:
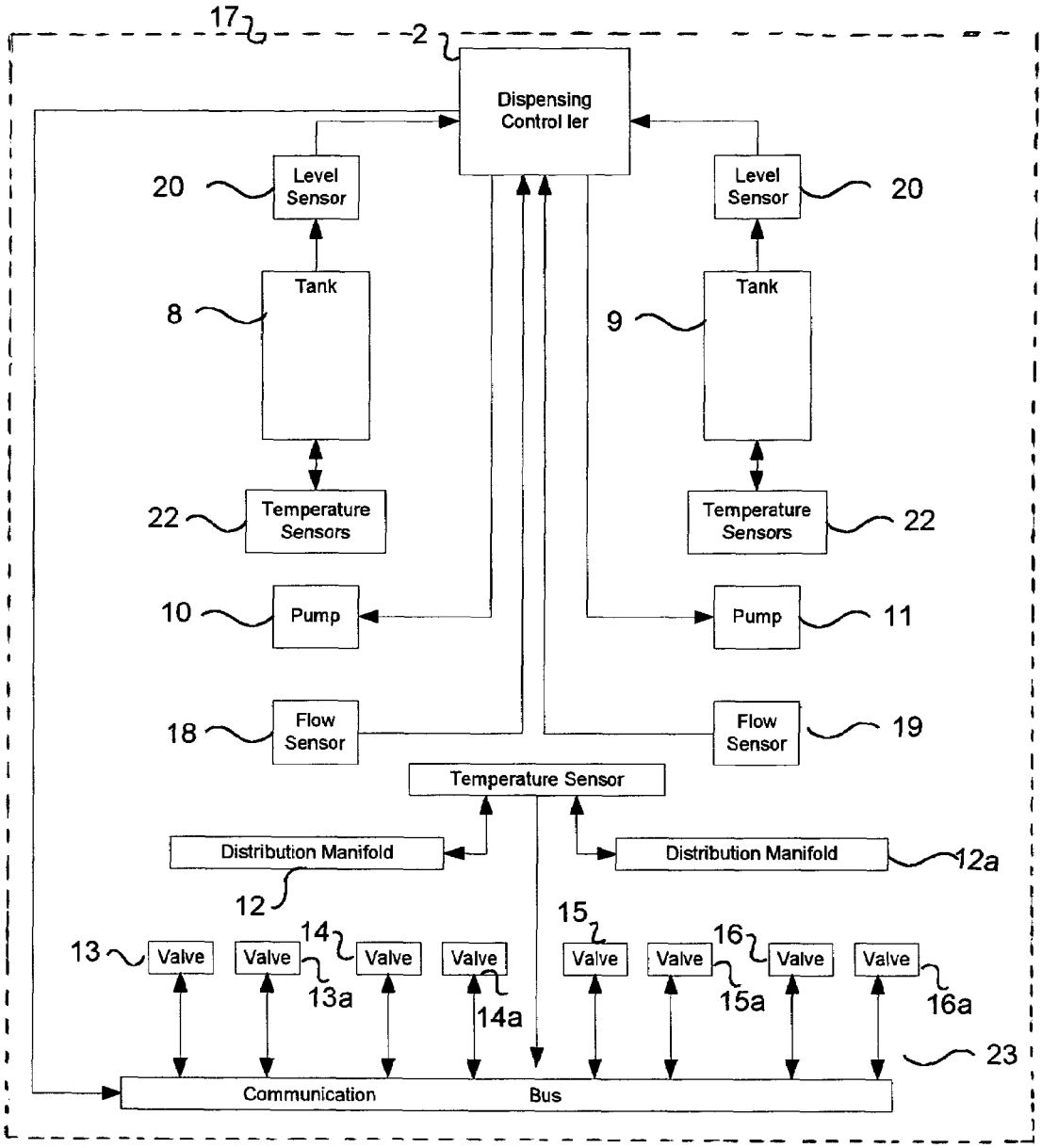
FIG. 3 is a schematic diagram of the dispensing control system of this invention.

The dispensing system 17 consists of several tanks, such as tanks 8 and 9, which contain the working fluids 5 and 6 available for use. The outlets of the tanks 8 and 9 are connected by conduits 21 through associated pumps 10 and 11 to the inlets of distribution manifolds 12*a* and 12*b*. The outlets of the manifolds 12*a* and 12*b* are in turn connected by conduits, through individually operated valves, such as 13*a*-16*a* and 13*b*-16*b* respectively, to each of the washing machines 100 of a group. For illustration, a group of four washing machines 100 are shown, but it should be noted that any convenient number of washers could be interconnected to form a group. This arrangement of tanks 8 and 9, conduits 21, pumps 10 and 11, manifolds 12*a* and 12*b*, and valves 13*a*-16*a* and 13*b*-16*b* form a fluid distribution system 17 which is controlled by dispensing controller 2, as shown in FIG. 3. The flow path for working fluids 5 and 6 is shown in FIG. 1 by heavy arrows, as indicated at 30.

Figure 6:
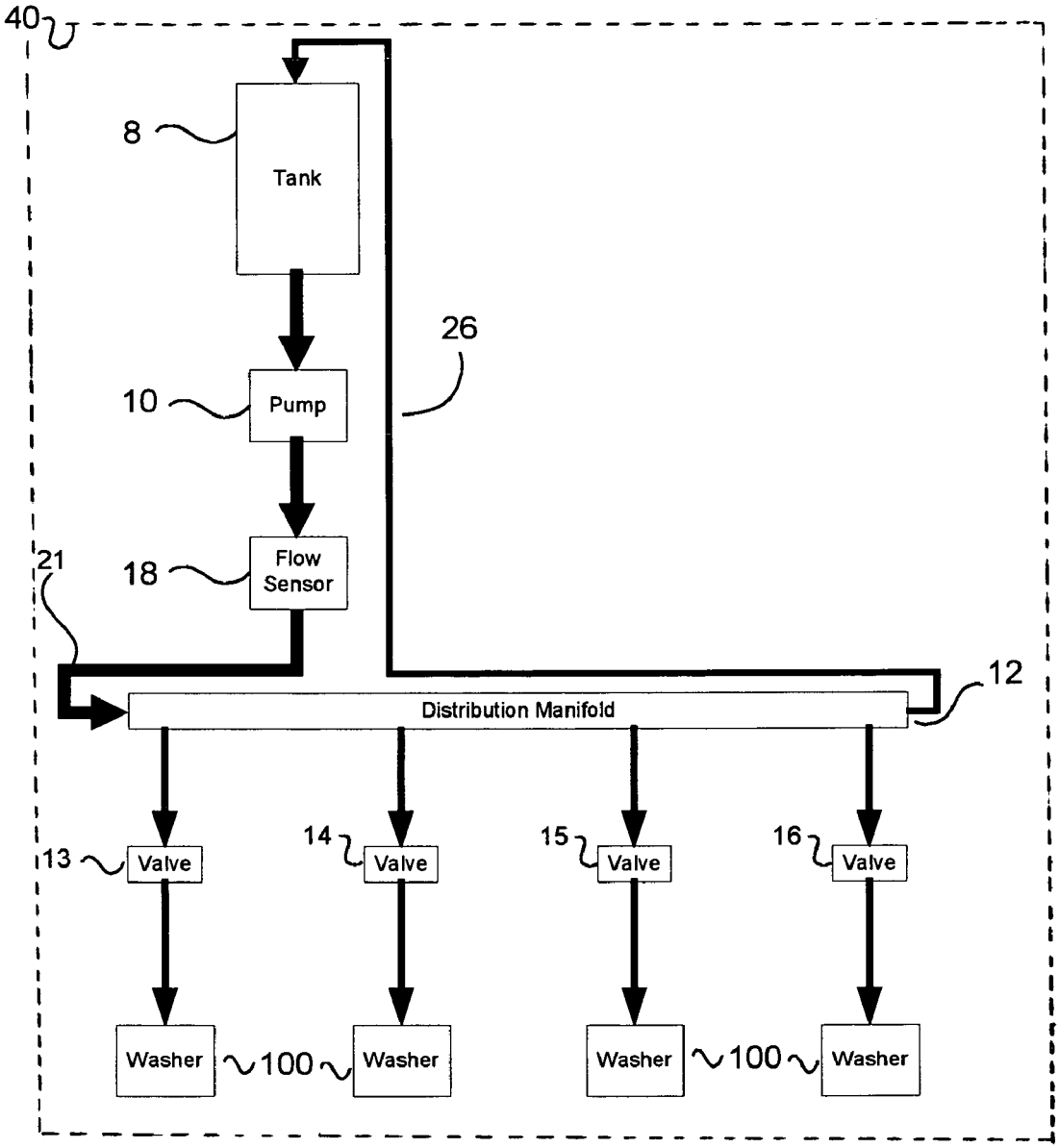
FIG. 6 is a flow diagram illustrating a fluid distribution loop for one of the washing fluids.

Each of the tanks 8 and 9 is operatively associated with an independent fluid distribution loop 40 as shown in FIG. 6. For example, tank 8 contains fluid 5, e.g., detergent, which is drawn out by the action of pump 10 and distributed to distribution manifold 12*a*. Manifold 12*a* is connected to the valves 13*a*-16*a* and to a return conduit 26. Return conduit 26 provides a path for working fluid 5 back to tank 8. A similar loop is associated with tank 9, i.e., pump 11, manifold 12*b* and return conduit 27.

Distribution manifolds 12*a* and 12*b* and their connected conduits provide a chamber in which working fluid will accumulate and an operational pressure is established. The fluid distribution loop of a particular tank 8 or 9 must be primed, and flowing at a particular pressure at the valve of the selected washer, before it is opened to deliver the working fluid 5 or 6 to the washing machine 100.

Since the dispensing system 17 operates automatically in a generally unattended location, it is necessary to provide an appropriate monitoring system to insure the proper functioning and integrity of the various flow paths. Flow sensors 18 and 19 are positioned to monitor the flow of fluids being received by the distribution manifolds 12*a* and 12*b* respectively. Flow sensors 18 and 19 are designed to indicate the flowing of working fluid in the manifolds as pumps 10 or 11 are energized. Sequentially the flow sensors will indicate the drop in fluid pressure as one of the valves 13*a*-16*a* or 13*b*-16*b* is opened to dispense working fluid to a selected washer 100. It may be advantageous to place additional flow sensors downstream of the valves to insure that working fluid is flowing to a washer 100. Flow meters, inserted in place of flow sensors 18 and 19, could be used to provide similar indications of flow integrity. Monitoring the power to pumps 10 and 11 would provide other indications of the dispensing sequence performance. A maximum fill time can be set at a point which would indicate that there is a failure in the dispensing system flow path. An appropriate alarm could be activated as well as a system shut down if necessary.

In an alternative embodiment, the tanks 8 and 9 may be equipped with a level detector 20 to monitor the supply of working fluids 5 and 6. As shown in FIG. 3, the output signals from the level detectors 20 are relayed to dispensing controller 2 either directly, as shown, or through communications bus 23.

The various electrical components of the dispensing system are connected to dispensing controller 2 either directly, or by means of communications bus 23. Once the dispensing sequence is cleared for operation by system controller 1, the dispensing controller 2 energizes pump 10 or pump 11 according to the working fluid selected. A short delay is programmed, as fluid is allowed to establish a suitable flow at an operating pressure in distribution manifold 12*a* or 12*b* and the conduit to the selected valves 13*a*-16*a* and 13*b*-16*b*. Once the desired fluid volume is achieved, dispensing controller 2 signals the opening of one of valves to deliver working fluid to the selected washer 100.

The dose of working fluids 5 and 6 dispensed into the washing machine is determined by the valve open time. This is a predetermined period, which is calibrated and stored for each working fluid. The valve will be closed at the expiration of the predetermined valve open time. A temperature sensor 24 may be provided to monitor the temperature of the working fluids in distribution manifolds 12*a* and 12*b*. Dispensing controller 2 receives the temperature signals through communications bus 23 and adjusts the calibrated valve open time to compensate for changes in working fluid viscosity due to temperature fluctuations. It may also be advantageous to sense the temperature of the fluids in tanks 8 and 9 through a temperature sensor or sensors 22. In this instance, working fluid could be circulated through the return conduits 26 or 27 until an equilibrium temperature is obtained before adjusting the valve open time. Since the viscosity of the working fluids are likely to be different, the valve open time is set at different intervals depending on the working fluid being dispensed.

System controller 1 receives signals from dispensing controller 2 indicative of the completion of the dispensing sequence. System controller 1 then clears the selected washing machine 100 for operation of the washing sequence through gang controller 3. As described above, each washing machine 100 is equipped with a separate controller 105, which, once cleared, operates the machine according to a cycle selected by the user. In the simplest embodiment, a flashing light is shown to the user while the pump is activated, thereby, signaling the user to start the washing cycle.

Control of the operation of the dispensing system 17 is according to a system algorithm, which is stored, for example, in memory 28 for access by system controller 1. The operating algorithm could also be imbedded in an ASIC or similar device. Before the system controller 1 initiates working fluid distribution, the algorithm responds to a selection of a washer to query the status of the particular washing machine 100 and acknowledge that it is ready for use. At this point in the control sequence the particular valve 13*a*-16*a* or 13*b*-16*b*, associated with the selected washer, is determined. A selection of working fluid prompts the algorithm to initiate a check of the fluid level in the tank of the selected working fluid. Providing there is a sufficient supply of the selected working fluid, dispensing commences. The pump 10 or 11, corresponding to the selected working fluid, is activated for a predetermined initial interval to fill the fluid distribution loop 40 to the valve of the selected washing machine 100 and insure a reliable flow at an operating pressure. This interval may be calibrated for each of the valves during set up of the system and stored in memory of processor 2 in a look up table or other accessible mechanism for use by the dispensing control algorithm. An appropriate timer or counter, triggered by the activation of the pump, is used to provide an indication of the fill interval. When the fill interval is expired, system controller 1 opens the selected valve.

If the system environment warrants, it may be beneficial to also provide an initial period of closed circulation of the working fluid through the manifold and back to the selected tank 8 or 9. The time period would be designed to provide a purging of air from the loop and to allow the temperature of the working fluid to equalize.

The valve open time is also a predetermined time period that is established in the set up of the system. Valve open time may be adjusted according to the temperature of the working fluid, as described above. During the dispensing of the working fluid, the fluid distribution loop 40 is monitored for continuity by means of the flow sensors 18 and 19. Abnormal indications in sensor readings will prompt the algorithm to call for the system to shut down. An appropriate signal, such as a flashing light, at the interface or the washing machine 100 will prompt the user to start the washing sequence, as selected by the user in a standard manner.

In operation the user offers a payment medium at the payment processor 25, e.g. swipes a credit card through a reader. After the payment medium is authorized, system controller 1 responds by prompting the user to select one of the washing machines 100. System controller 1 checks the status of the selected machine 100 and, if available, prompts the user to make a selection of working fluids 5 or 6. The amount of the transaction is calculated, including the washing sequence and the selected fluids, and processed through the chosen payment medium. The system controller 1 then initiates the dispensing of working fluids through the fluid distribution system 17.

Figure 5:
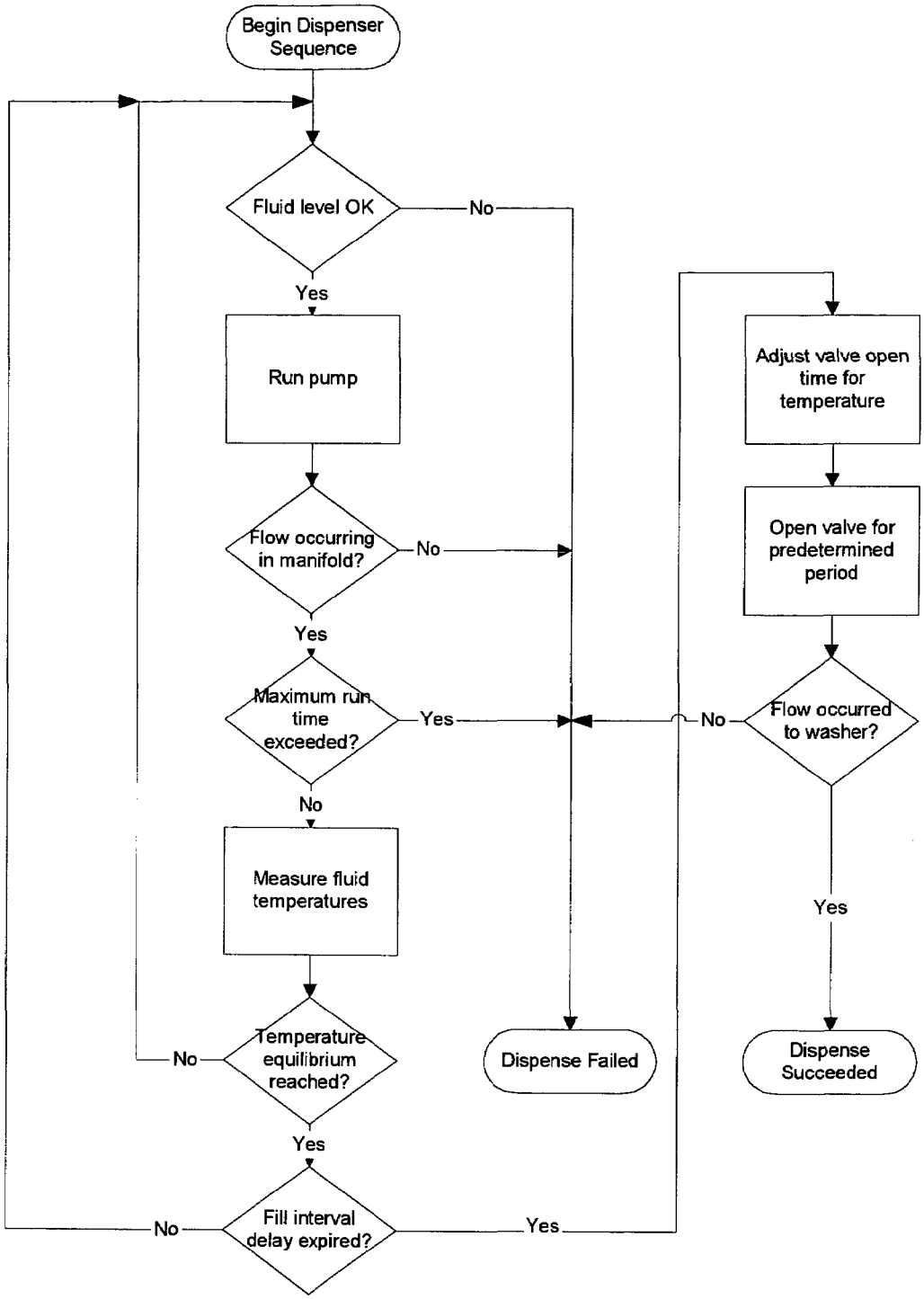
FIG. 5 is an illustration of the control algorithm for the washing fluid dispensing sequence.

As shown in FIG. 5, dispensing system control processor 2 directs the dispensing sequence according to an algorithm imbedded or stored in memory 28. At the outset dispensing controller 2 checks for sufficient supply of the selected washing fluid 5 or 6. This can be accomplished by monitoring the level of the fluid in tanks 8 and 9 by level sensors 20, by counting the number of dispense cycles, or other convenient means. In addition the temperature of the working fluid selected is checked, preferably at the tank (sensor 22) and further downstream, for example at the distribution manifold (sensor 24). By comparing the readings provided by temperature sensors 22 and comparing them to those obtained at temperature sensors 24, an indication of temperature equilibrium throughout the fluid distribution system can be determined. If the readings are different, the algorithm may direct the control processor 2 to continue to pump without opening one of the valves 13*a*-16*a*, 13*b*-16*b*. This will cause recirculation of the working fluid through return conduits 26 and 27 until equilibrium is reached and an accurate temperature reading of the working fluid may be obtained.

Assuming the presence of a sufficient amount of selected working fluid 5 or 6, the associated pump is energized. The algorithm provides a delay before valve actuation in order to allow a sufficient flow to be established in the manifold and connecting conduits to fill and establish a predetermined working pressure at the selected valve. The fill interval may be different for each valve and this is calibrated during set up of the system, according to the associated length of flow path, and stored in memory in the form of a look up table. The algorithm, therefore, prompts an adjustment in the fill interval depending on the valve of the selected washing machine.

After the expiration of the fill interval, a valve is opened for a predetermined time period to supply the preferred dosage of the selected working fluid to the machine 100. This time period varies with the working fluid and must be calibrated during set up of the system. An adjustment of the valve open time is provided according to the temperature of the working fluid established by temperature sensors 22 and 24. The adjustment is made according to the characteristic viscosity of the particular working fluid to compensate for changes in flow rates caused by temperature fluctuation. Also the algorithm is designed to select the valve open time according to the working fluid being dispensed.

In this manner a payment system and sequence, and a dispensing system and sequence is integrated with the individual control systems and sequences for multiple washing machines arranged in public laundry facilities such as Laundromats, dormitories, apartment complexes and the like. This is accomplished to provide accurately metered amounts of detergent, bleach, and/or softeners and other chemical fluids to the washing machines. The convenience of integrating the payment process greatly facilitates the operation of public laundry facilities. This is accomplished in a manner, which permits installation of the system by retrofitting existing systems or as a turn-key new facility.

We claim:

1. A system for controlling the operation of a pay-as-you-go laundry facility that includes multiple washing machines using at least one working fluid, comprising:

a centralized fluid distribution system for dispensing a metered amount of working fluid to each of said multiple washing machines;

a dispensing controller for controlling said centralized fluid distribution system according to a predetermined dispensing sequence;

a washing sequence controller at each of said washing machines, connected to independently operate a washing machine according to a selected washing sequence;

a payment processor constructed to receive and approve a payment medium presented by the user according to a predetermined payment sequence;

a system controller connected to said payment processor, said washing sequence controller, and said dispensing controller to receive inputs therefrom and to generate and send control signals thereto according to a predetermined control sequence.

2. A system for controlling the operation of a pay-as-you-go laundry facility that includes multiple washing machines using at least one working fluid, as described in claim 1, wherein a user interface is operatively connected to said system controller to allow the user to make selections in response to prompts from said system controller.

3. A system for controlling the operation of a pay-as-you-go laundry facility that includes multiple washing machines using at least one working fluid, as described in claim 1, wherein said system controller is connected to the multiple washing machines through a gang controller which monitors the status of the washing machines and controls said washing machine controllers.

4. A system for controlling the operation of a pay-as-you-go laundry facility that includes multiple washing machines using at least one working fluid, as described in claim 1, wherein said centralized fluid distribution system comprises;

at least one tank for holding a working fluid;

a pump for moving working fluid downstream from said tank under pressure into a distribution conduit;

a distribution manifold connected to receive working fluid pumped from said tank and distribute said fluid to multiple conduits connected to said multiple washing machines;

a valve connected in each of said washing machine conduits to control the flow of working fluid therein; and wherein said pump and said valve are controlled by signals from said dispensing controller to dispense a metered amount of working fluid according to a predetermined dosage.

5. A system for controlling the operation of a pay-as-you-go laundry facility that includes multiple washing machines using at least one working fluid, as described in claim 4, wherein said centralized fluid distribution system further comprises a system of sensors for monitoring the flow continuity of said fluid distribution system.

6. A system for controlling the operation of a pay-as-you-go laundry facility that includes multiple washing machines using at least one working fluid, as described in claim 5, wherein said system of sensors comprises a first flow sensor connected in said distribution conduit downstream of said pump for generating a first signal indicative of the flow of working fluid therein, said first signal being sent to said dispensing controller.

7. A system for controlling the operation of a pay-as-you-go laundry facility that includes multiple washing machines using at least one working fluid, as described in claim 6, wherein said system of sensors further comprises a second flow sensor connected in said distribution conduit downstream of said valve for generating a second signal indicative of the flow of working fluid therein, said second signal being sent to said dispensing controller.

8. A system for controlling the operation of a pay-as-you-go laundry facility that includes multiple washing machines using at least one working fluid, as described in claim 4, wherein said centralized fluid distribution system further comprises a temperature sensor for sensing the temperature of said working fluid and sending a signal indicative thereof to said, dispensing controller.

9. A system for controlling the operation of a pay-as-you-go laundry facility that includes multiple washing machines using at least one working fluid, as described in claim 8, wherein said temperature sensor is positioned to sense the temperature of the working fluid in said distribution manifold.

10. A system for controlling the operation of a pay-as-you-go laundry facility that includes multiple washing machines using at least one working fluid, as described in claim 4, wherein said centralized fluid distribution system further comprises at least a second tank for holding a second working fluid wherein said second tank is connected to:

a second pump for moving working fluid downstream from said second tank under pressure into a second distribution conduit;

a second distribution manifold connected to receive said second working fluid pumped from said second tank and distribute said second fluid to second multiple conduits connected to said multiple washing machines;

a second valve connected in each of said second washing machine conduits to control the flow of said second working fluid therein; and wherein said second pump and said second valve are controlled by signals from said dispensing controller to dispense a metered amount of said second working fluid according to a predetermined dosage.

11. A system for controlling the operation of a pay-as-you-go laundry facility that includes multiple washing machines using at least one working fluid, as described in claim 4, wherein said tank includes a level sensor to monitor the supply of working fluid therein.

12. A system for controlling the operation of a pay-as-you-go laundry facility that includes multiple washing machines using at least one working fluid, as described in claim 1, wherein said payment processor comprises a card reader to receive a payment card from said user, said payment processor being in communication with a remote transaction authorization system.

13. A system for controlling the operation of a pay-as-you-go laundry facility that includes multiple washing machines using at least one working fluid, as described in claim 1, wherein said payment processor comprises a card reader to receive a stored-value payment card from said user and to deduct the payment from the balance stored on the card.

14. A system for controlling the operation of a pay-as-you-go laundry facility that includes multiple washing machines using at least one working fluid, as described in claim 1, wherein said payment processor comprises a mechanism for accepting cash payments.

15. A system for controlling the operation of a pay-as-you-go laundry facility that includes multiple washing machines using at least one working fluid, as described in claim 1, further comprising a first algorithm operatively associated with said system controller and wherein said first algorithm causes said system controller to activate said dispensing system control processor in response to acceptance of said payment medium by said payment processor.

16. A system for controlling the operation of a pay-as-you-go laundry facility that includes multiple washing machines using at least one working fluid, as described in claim 15, wherein said first algorithm causes said system controller to prompt said user, through said user interface, to select one of said multiple washing machines and to check the status of the selected washing machine in response to said user's selection.

17. A system for controlling the operation of a pay-as-you-go laundry facility that includes multiple washing machines using at least one working fluid, as described in claim 16, wherein said first algorithm further causes said system controller to check the supply of working fluids and prompt said user, through said user interface, to select only those said working fluids that are currently available.

18. A system for controlling the operation of a pay-as-you-go laundry facility that includes multiple washing machines using at least one working fluid, as described in claim 1, wherein said dispensing controller further comprises a second algorithm operatively associated with said dispensing controller and wherein said second algorithm causes said dispensing controller to activate said pump for a predetermined interval, prior to dispensing, to allow said working fluid to fill said fluid distribution system to the valve associated with the selected washing machine in response to a signal from said system controller.

19. A system for controlling the operation of a pay-as-you-go laundry facility that includes multiple washing machines using at least one working fluid, as described in claim 18, wherein said second algorithm causes said dispensing controller to vary the fill interval according to the working fluid being dispensed.

20. A system for controlling the operation of a pay-as-you-go laundry facility that includes multiple washing machines using at least one working fluid, as described in claim 18, wherein said second algorithm causes said dispensing controller to open said valve for a predetermined period to dispense a metered dosage of working fluid to the selected washing machine after the expiration of said fill interval.

21. A system for controlling the operation of a pay-as-you-go laundry facility that includes multiple washing machines using at least one working fluid, as described in claim 18, wherein said second algorithm causes said dispensing controller to check the continuity of the fluid distribution system during dispensing of working fluid.

22. A system for controlling the operation of a pay-as-you-go laundry facility that includes multiple washing machines using at least one working fluid, as described in claim 18, wherein said second algorithm causes said dispensing controller to adjust the open time of the valve according to the temperature of the working fluid.

23. In a system for controlling the operation of a pay-as-you-go laundry facility that includes multiple washing machines using at least one working fluid, a method for dispensing working fluid comprising the steps of:

prompting the user to present a payment medium;

prompting the user to select a washing machine and verifying the available status thereof;

activating the selected washing machine;

sensing the availability of working fluid for dispensing in a reservoir for said working fluid;

prompting the user to select a working fluid;

processing a transaction according to the selections made by the user to verify authenticity of the payment medium and authorize payment; and in response to payment, dispensing a metered dosage of the selected working fluid to the selected washing machine.

24. In a system for controlling the operation of a pay-as-you-go laundry facility that includes multiple washing machines using at least one working fluid, a method for dispensing working fluid, according to claim 23, further comprising the step of monitoring the availability of working fluid by counting the number 6*f* dosages dispensed.

25. In a system for controlling the operation of a pay-as-you-go laundry facility that includes multiple washing machines using at least one working fluid, a method for dispensing working fluid, according to claim 23, further comprising the step of monitoring the availability of working fluid by sensing the level of working fluid in the reservoir for said working fluid.

26. In a system for controlling the operation of a pay-as-you-go laundry facility that includes multiple washing machines using at least one working fluid, a method for dispensing working fluid, according to claim 23, wherein the step of dispensing a metered dosage of the selected working fluid to the selected washing machine further comprises the steps of:

activating a pump to fill a distribution manifold with the selected working fluid;

connecting the manifold to the selected washing machine through a conduit;

controlling the flow of working fluid in the conduit by means of a valve;

opening said valve to allow working fluid to flow to said washing machine for a predetermined time in order to deliver a predetermined dosage of the selected working fluid.

27. In a system for controlling the operation of a pay-as-you-go laundry facility that includes multiple washing machines using at least one working fluid, a method for dispensing working fluid, according to claim 25, further comprising the step of delaying the opening of the valve for a predetermined fill interval to allow the working fluid to establish a flow in the manifold and conduit.

28. In a system for controlling the operation of a pay-as-you-go laundry facility that includes multiple washing machines using at least one working fluid, a method for dispensing working fluid, according to claim 27, wherein the step of opening said valve to allow working fluid to flow to said washing machine for a predetermined time further comprises the steps of:

checking the temperature of the working fluid; and adjusting the fill interval according to said temperature.

29. In a system for controlling the operation of a pay-as-you-go laundry facility that includes multiple washing machines using at least one working fluid, a method for dispensing working fluid, according to claim 23, further comprising the step of checking the continuity of the working fluid flow path through the manifold and conduit.

30. In a system for controlling the operation of a pay-as-you-go laundry facility that includes multiple washing machines using at least one working fluid, a method for dispensing working fluid, according to claim 29, wherein the step of checking the continuity of the working fluid flow path through the manifold and conduit is accomplished by placing at least one flow sensor in the working fluid flow path and monitoring the signals from said flow sensor.

31. In a system for controlling the operation of a pay-as-you-go laundry facility that includes multiple washing machines using at least one working fluid, a method for dispensing working fluid, according to claim 29, further comprising the step of checking the continuity of the working fluid flow path through the manifold and conduit by monitoring the activation time period of the pump and setting a maximum run time indicative of failed continuity.

32. In a system for controlling the operation of a pay-as-you-go laundry facility that includes multiple washing machines using at least one working fluid, a method for dispensing working fluid, according to claim 28, wherein the sensing of the temperature is delayed for a predetermined interval to allow the temperature to reach equilibrium.

33. In a system for controlling the operation of a pay-as-you-go laundry facility that includes multiple washing machines using at least one working fluid, a method for dispensing working fluid, according to claim 32, wherein temperature equilibrium is determined by sensing the temperature of the working fluid in the reservoir and in the manifold and determining equilibrium when said sensed temperatures are equal.

34. In a system for controlling the operation of a pay-as-you-go laundry facility that includes multiple washing machines using at least one working fluid, a method for dispensing working fluid, according to claim 27, wherein the fill interval is adjusted depending on the selected washing machine to accommodate different lengths of flow paths for the washing machines.

35. A system for controlling the operation of a pay-as-you-go laundry facility that includes multiple washing machines using at least one working fluid, comprising:

a centralized fluid distribution system for dispensing a metered amount of working fluid to each of said multiple washing machines;

a dispensing controller for controlling said centralized fluid distribution system according to a predetermined dispensing sequence;

a washing sequence controller at each of said washing machines, connected to independently operate a washing machine according to a selected washing sequence;

a system controller at each of said washing machines, connected to said washing sequence controller, and said dispensing controller to receive inputs therefrom and to generate and send control signals thereto according to a predetermined control sequence; and further wherein said centralized fluid distribution system comprises:

at least one tank for holding a working fluid;

a pump for moving working fluid downstream from said tank under pressure into a distribution conduit;

a distribution manifold connected to receive working fluid pumped from said tank and distribute said fluid to multiple conduits connected to said multiple washing machines;

a valve connected in each of said washing machine conduits to control the flow of working fluid therein; and wherein said pump and said valve are controlled by signals from said dispensing controller to dispense a metered amount of working fluid according to a predetermined dosage.

36. A system for controlling the operation of a pay-as-you-go laundry facility that includes multiple washing machines using at least one working fluid, as described in claim 35 further comprising a payment processor constructed to receive and approve a payment medium presented by the user according to a predetermined payment sequence.

* * * * *